US006618069B2

(12) United States Patent
Schuster et al.

(10) Patent No.: US 6,618,069 B2
(45) Date of Patent: Sep. 9, 2003

(54) METHOD AND APPARATUS FOR PRODUCING A THERMAL TRANSFER PRINT BY MEANS OF A TAPE-LIKE TRANSFER FILM

(75) Inventors: Alfons Schuster, Augsburg (DE); Armin Weichmann, Kissing (DE); Bernhard Feller, Friedberg (DE); Dirk Probian, Gablingen/Lützelburg (DE); Michael Müller, Augsburg (DE); Thomas Hartmann, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/931,530

(22) Filed: Aug. 16, 2001

(65) Prior Publication Data

US 2002/0047888 A1 Apr. 25, 2002

Related U.S. Application Data

(63) Continuation-in-part of application No. 09/268,392, filed on Mar. 15, 1999, now abandoned.

(30) Foreign Application Priority Data

Mar. 13, 1998 (DE) ..... 198 11 028

(51) Int. Cl.[7] ..... B41J 2/435

(52) U.S. Cl. ..... 347/224; 347/171

(58) Field of Search ..... 347/176, 171, 347/217, 188, 224; 101/467; 400/223

(56) References Cited

U.S. PATENT DOCUMENTS

| | | | | |
|---|---|---|---|---|
| 4,577,198 A | * | 3/1986 | Hibino et al. | 346/76 |
| 5,601,022 A | | 2/1997 | Dauer et al. | 101/467 |
| 5,691,961 A | | 11/1997 | Paranjpe | 347/217 |

FOREIGN PATENT DOCUMENTS

| | | |
|---|---|---|
| DE | 31 08 528 | 9/1983 |
| DE | 44 30 555 | 4/1996 |

* cited by examiner

*Primary Examiner*—John Barlow
*Assistant Examiner*—Lam Nguyen
(74) *Attorney, Agent, or Firm*—Cohen, Pontani, Lieberman & Pavane

(57) ABSTRACT

A method of producing a thermal transfer print, including the steps of controlled imagewise heating of a surface layer of the print by means of a laser beam from a laser writing head; applying selected area elements to a substrate using a tape-like transfer film with a width which is small in relation to a width of the substrate, transporting the transfer film continuously between the substrate and the laser beam, close to the substrate surface during imaging moving the transfer film over the substrate width simultaneously and in synchronism with movement of the laser writing head the width of the transfer film being sufficiently large for a number of imaging tracks to be used alongside one another, and selecting an as yet unused track for each imaging operation.

5 Claims, 3 Drawing Sheets

METHOD AND APPARATUS FOR PRODUCING A THERMAL TRANSFER PRINT BY MEANS OF A TAPE-LIKE TRANSFER FILM

This application is a Continuation-in-Part of U.S. patent application Ser. No. 09/268,392 filed Mar. 15, 1999 now abandoned which claims priority an Application filed in Germany on Mar. 13, 1998, No. 198 11 028.6.

BACKGROUND OF THE INVENTION

1. Field of the Invention

The invention relates to a method and an apparatus for producing a thermal transfer print, especially a printing form or a proof, by controlled imagewise heating of a surface layer by means of one or more laser beams and applying the selected area elements to the substrate.

The substrate may be a print material, such as paper, an intermediate carrier to be transferred subsequently to the print material or a printing form, that is to say a printing plate or, in particular, a seamless printing-form cylinder or a seamless printing-form sleeve.

2. Discussion of the Prior Art

Coating a substrate in this way, ill particular by means of a laser, is disclosed by German reference DE 44 30 555 C1. This reference describes a method and an apparatus which enables simple production of a printing form, especially on a seamless printing-form cylinder with a smooth surface, and allows it to be integrated into the printing machine, without the gases which are produced in the laser imaging operation noticeably interfering with the material transfer from the thermal transfer film, that is to say the imaging quality.

A tape-like transfer film having a tape width which is only a fraction of the substrate width is transported between the substrate and the imaging unit, in the direct vicinity of the substrate surface, by means of a tape transport mechanism. The tape transport mechanism, together with the imaging unit and coupled electronically or mechanically, is mounted on a traversing unit, so that the transfer film can be moved over the substrate width uniformly with the movement of the imaging unit.

In conjunction with the laser-induced thermal imaging unit, which is controlled in a known way a by means of a control unit in accordance with an image to be transferred and which, for each image point, introduces heat onto the thermal transfer film, and thus performs a dot-by-dot transfer of the ink-accepting coating of the transfer tape, it is thus possible for the complete substrate, in particular the complete seamless printing-form cylinder, to be imaged all round.

However, at those points which have already been transferred during an imaging operation, the transfer tape can in principle not be reused, analogously to a carbon ribbon in a conventional typewriter. Hence, in the reference cited, the tape can be used only once per section. In order to achieve a number of imaging operations without changing the tape, a very great tape length is therefore necessary. However, the tape length directly influences the diameter of the reel, so that even in the case of a very small number of imaging operations per tape, the reel becomes unfavourably large.

SUMMARY OF THE INVENTION

The object of the present invention is therefore to make it possible to carry out a larger number of imaging operations without changing the transfer tape.

Use is made of a transfer tape of a width which is a multiple of the width of the writing tracks of the laser imaging unit. It is thus possible to write a number of tracks alongside one another for various imaging operations. This enables the same section of the transfer tape to be used for a number Of imaging operations. In this case, the position of the point or points of incidence of the laser beam or beams, that is to say the writing track of the laser on the transfer tape, has to be shifted in each case, so that the tracks do not overlap and, an unused track is used for each imaging operation.

It is of course nevertheless possible for the tape lengths to be a multiple of the lengths needed for the imaging operation, so that via a combination of tracks located alongside one another and after one another, a large number of imaging operations per tape becomes possible. The tape is changed only when all the tracks have been used up.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Exemplary embodiments of the invention are explained below with reference to the drawing, in which, in highly schematic form.

DETAILED DESCRIPTION OF THE PREFERRED EMBODIMENTS

The addressing, the construction and the mode of action of a printing head which emits one or more laser beams are known per se and therefore do not need more detailed explanation in the present connection.

Figure 1:
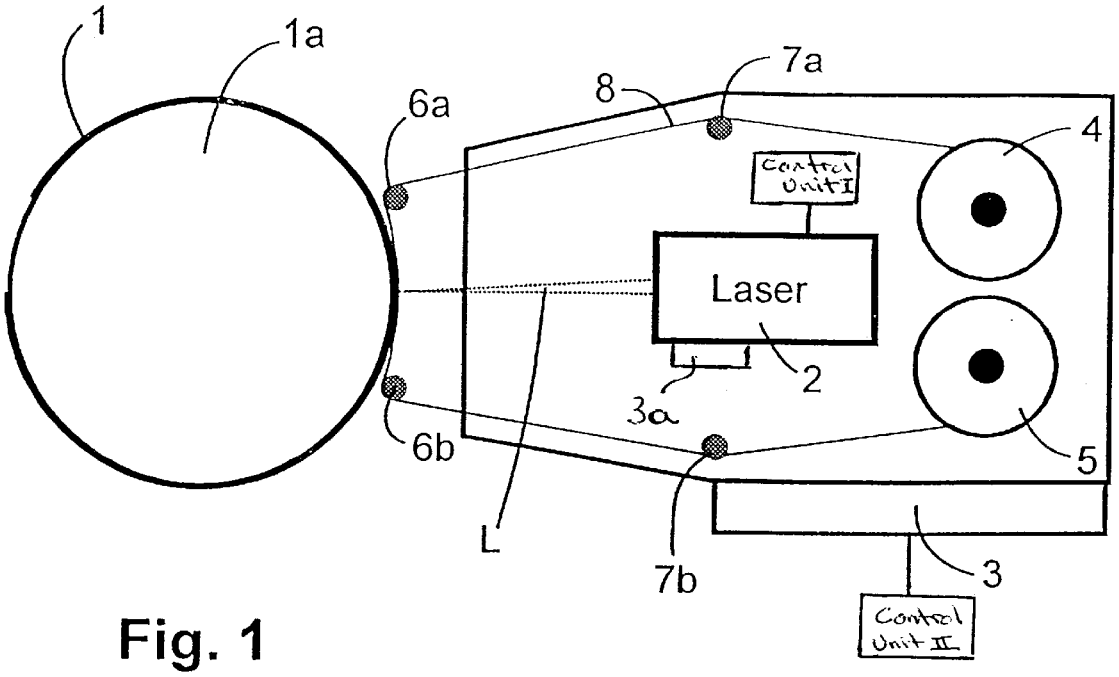
FIG. 1 is a side view of a thermal transfer apparatus for implementing the inventive method with a first tape guide mechanism.

FIG. 1 shows a substrate cylinder 1 to whose surface a substrate 1*a* has been applied. A tape transport mechanism, comprising a supply roll 4 and a wind-up roll 5 (the identification of the supply roll 4 and of the wind-up roll 5 is merely representative of one running direction of the tape-like thermal transfer film 8, in the opposite direction these would of course have to be supply roll 5 and wind-up roll 4), two contact rolls 6*a*, 6*b* and two guide rolls 7*a*, 7*b* guide a tape-like thermal transfer film 8, referred to below as transfer tape, close to the substrate cylinder 1 or in contact with the substrate 1*a*.

A laser writing unit 2 focuses one or more laser beams L onto the transfer tape 8. In the preferred arrangement, the laser writing unit 2 and the tape guide mechanism 4, 5, 6, 7 are jointly arranged on a traversing unit 3, by means of which they can be moved over the width B of the substrate cylinder 1.

Figure 2:
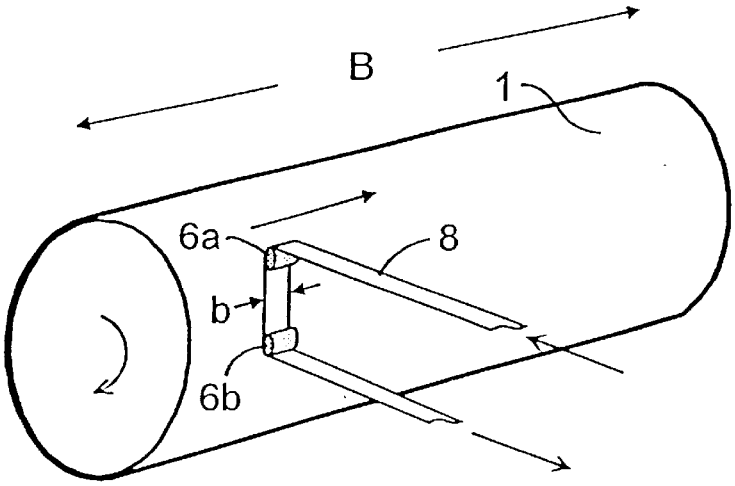
FIG. 2 is a perspective view of a possible way of bringing the transfer film into contact with the substrate surface.

This arrangement is shown in perspective form in FIG. 2. In the illustrated embodiment, the transfer film 8 preferably has a tape width of 20 mm and a thickness of about 12 $\mu$m. By comparison, the width B of a substrate cylinder 1 is typically 700 mm. The imaging track is typically about 1 mm.

Figure 4:
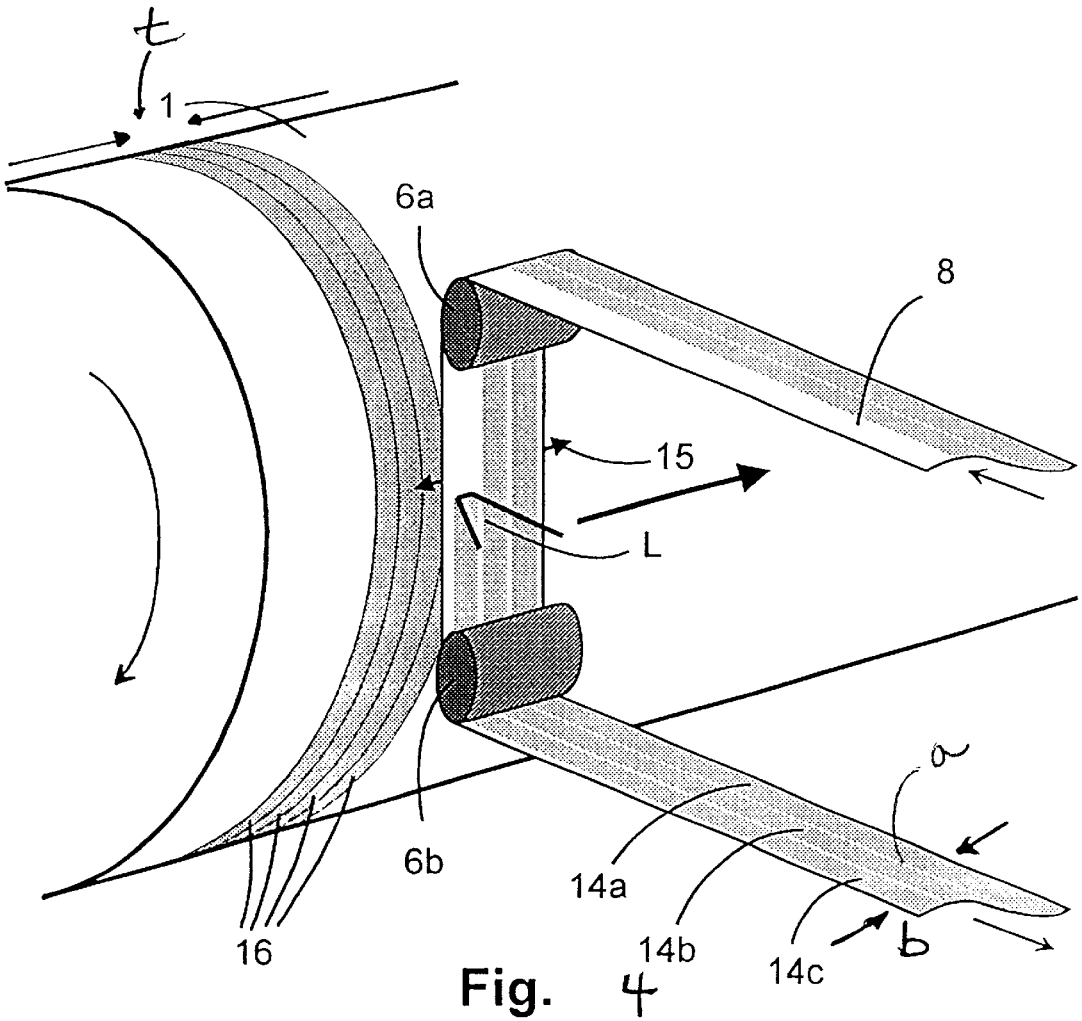
FIG. 4 is a perspective view showing the lateral shifting of the transfer tape in relation to the laser beam.

FIG. 4 shows the multiple use of the transfer tape 8 via the provision of unused tracks. According to the invention, this is achieved by the tape 8 having a width b which is a multiple of the imaging width t. The transfer tape 8 is then divided up into imaging tracks 14*a*, 14*b*, 14*c* and one track is provided for each imaging operation.

For this purpose, it must be possible for the transfer tape 8 to be shifted in a defined way, indicated by the arrows 15, in relation to the laser beam or beams L. Overall, for one imaging operation, the apparatus of course still traverses over the substrate cylinder width B in synchronism with the laser imaging unit and writes one track 16 for each cylinder revolution, until the entire area to be imaged has been covered.

As a result of the unavoidable inaccuracies in tape guidance, it is not possible for one track to adjoin the next precisely. For this reason, a safety margin a is observed and is selected to be somewhat greater than the maximum lateral movements of the transfer tape which occur. Hence, the track width s of the laser imaging unit plus the safety margin "a" is needed for one imaging operation, and n=INT(b/(s+a)) imaging operations alongside one another are possible, where INT(x) is equal to the largest integer less than x.

During the imaging operation, the tape is unwound from the supply roll 4 and wound up on the wind-up roll 5. Following the imaging operation, in a position where there is no contact between the transfer tape 8 and substrate 1*a* or substrate cylinder 1, the transfer tape is then wound back again, shifted to a track which has not yet been used, that is to say by at least the distance s+a, and is then ready for the next imaging operation. The tape is changed only when all the tracks have been used up.

It is of course not necessary for the written tracks to be located directly alongside one another in each case: it may prove to be expedient, for example, to write the furthest right track first, then the furthest left, then the second furthest right, then the second furthest left and so on, or beginning from the center to use first the most central, then the one to the left, then the one to the right of the center and so on. A different, more irregular sequence of the tracks may also be expedient for reasons connected with winding up the tape cleanly and with reel stability.

In another embodiment of the invention the tape reel is enlarged so that a number of successive imaging operations are possible. In combination with imaging of tracks lying alongside one another, the number of possible successive imaging operations is multiplied by the number of possible imaging operations alongside one another.

Such a large number or such an irregular sequence of tracks must of course be managed by means of a software program which in each case positions a free track and then also indicates and effects complete utilization and hence changing of the tape.

One variant for mechanical direct coupling of the tape transport mechanism and laser imaging unit is independent mechanical traversing of the tape transport mechanism and laser imaging unit, the synchronous movement being achieved electronically. In this case, the tape transport mechanism and the laser imaging unit each have their own traversing drive 3, 3*a*, and the synchronous shifting is achieved by means of electronic coupling. Shifting the transfer tape in relation to the laser imaging head in order to provide unused tracks is then readily possible simply by changing the distance between the tape transport mechanism and laser imaging unit.

Figure 3:
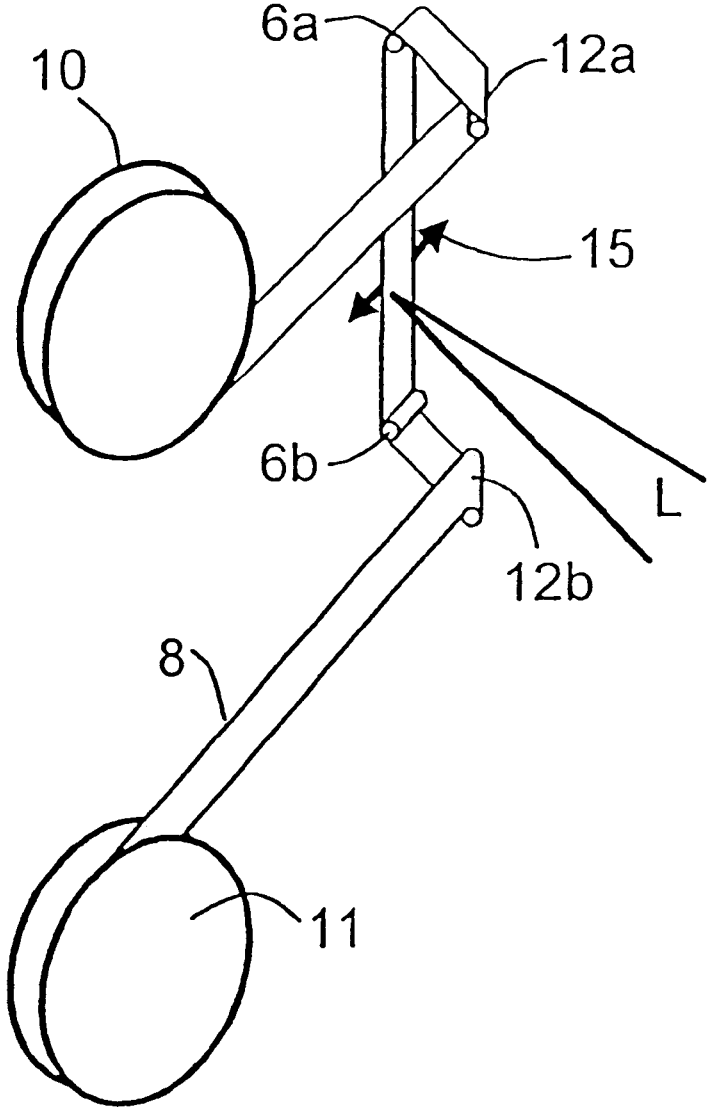
FIG. 3 is a perspective view of a second tape guide mechanism.

A further embodiment of an apparatus for implementing the method for laser-induced thermal transfer is shown by FIG. 3. Here, the tape transport mechanism comprises a supply roll 10 and a wind-up roll 11, each arranged in a fixed position (of course, the identification 10 and 11 for the supply roll and wind-up roll can again be exchanged here). Two rolls 6*a*, 6*b*, are arranged axially parallel to the substrate cylinder 1, for bringing the transfer film 8 into contact with the substrate surface, and two further the deflection rolls 12*a*, 12*b* are provided. The contact rolls 6*a*, 6*b* and the deflection rolls 12*a*, 12*b* can be traversed, together with the laser imaging unit 2, along the width B of the substrate cylinder 1 by means of a traversing unit, in a fixed arrangement in relation to each other but independently of the supply roll 10 and the wind-up roll 11, which are arranged in a fixed position.

In order to position different tracks, it is additionally possible for the deflection rolls 12*a*, 12*b* and the contact rolls 6*a*, 6*b* to be shifted in a defined way in relation to the laser imaging unit, shown symbolically in FIG. 3 by the short arrows 15.

The invention is not limited by the embodiments described above which are presented as examples only but can be modified in various ways within the scope of protection defined by the appended patent claims.

We claim:

1. An apparatus for producing a thermal transfer print, comprising:

a laser imaging unit which emits a laser beam and is movable over a width of a substrate mounted on a cylinder;

tape transport means for guiding a tape-like transfer film having a width that is small in relation to a width of the substrate;

a traversing unit coupled to the laser imaging unit so that at least that part of the tape-like transfer film which outputs area elements is uniformly moved over the substrate width along with movement of the imaging unit, the width of the tape-like transfer film being such that a number of imaging tracks alongside one another are arranged across the width of the tape-like transfer film, the traversing unit being operative to position the tape tape-like transfer film during an imaging operation so that the laser beam strikes one of the number of imaging tracks which has not yet been used, the tape transport means including a supply roll, a wind-up roll and at least two rolls arranged axially parallel to the substrate width so as to bring the tape-like transfer film into contact with the substrate surface, and further comprising an additional traversing unit, the tape transport means and the imaging unit being mounted on respective ones of the traversing units, each traversing unit having a control unit so that the tape transport means and the laser imaging unit are moveable independently of each other so that the laser imaging unit is movable relative to the tape-like transfer film across a width of the tape-like transfer film to address the different imaging tracks, wherein the number of imaging tracks across the width of the tape-like transfer film is determined on the following equation:

$$n=INT(b/(s+a))$$

where, b=the width of the tape-like transfer film, s=a track width of the laser imaging unit, a=a safety margin width arranged between each track, n=the number of imaging tracks possible across the width of the tape-like transfer film, and INT(x)=the largest integer less than x, thereby facilitating the most efficient use for various widths of the tape-like transfer film.

2. The apparatus of claim 1, further comprising program means for determining the number of imaging tracks across the width of the tape-like transfer film using the equation.

3. The apparatus of claim 1, further comprising program means for relatively moving the imaging unit and the tape transport mechanism for shifting from a completed one of the imaging tracks to another one of the imaging tracks which is not yet used according to a sequence based on the determined number of imaging tracks.

4. The apparatus of claim 3, wherein the sequence of imaging tracks comprises alternately using the furthest available track on a right side of the tape-like transfer film and the furthest available track on a left side of the tape-like transfer film.

5. The apparatus of claim 3, wherein the sequence of imaging tracks is an irregular sequence arranged for optimizing reel stability and clean winding of the tape-like transfer film.

* * * * *